US005343823A

United States Patent [19]

Blaha

[11] Patent Number: 5,343,823

[45] Date of Patent: Sep. 6, 1994

[54] LARGE DIAMETER LOW RPM PROPELLER FOR TORPEDOES

[75] Inventor: John G. Blaha, Garden Grove, Calif.

[73] Assignee: Hughes Aircraft Company, Los Angeles, Calif.

[21] Appl. No.: 41,535

[22] Filed: Apr. 1, 1993

Related U.S. Application Data

[63] Continuation of Ser. No. 819,430, Jan. 10, 1992.

[51] Int. Cl.[5] ..... B63G 8/08

[52] U.S. Cl. ..... 114/338; 416/128; 416/143

[58] Field of Search ..... 416/142 R, 142 A, 142 B, 416/143, 120, 124–129; 114/312, 337, 338, 20 R, 20 A; 440/49, 79–81

[56] References Cited

U.S. PATENT DOCUMENTS

| | | | |
|---|---|---|---|
| 1,450,597 | 4/1923 | Kasley | 114/20 |
| 2,094,997 | 10/1937 | Lucich | 114/20 |
| 2,419,173 | 4/1947 | Smith | 114/20 |
| 2,532,371 | 12/1950 | Petersen | 170/160.12 |
| 2,608,257 | 8/1952 | Godfrey | 416/142 A |
| 2,847,960 | 8/1958 | Endrezze et al. | 114/20 |
| 3,047,726 | 7/1962 | Warnken | 416/143 |
| 3,301,210 | 1/1967 | Oeland, Jr. | 114/20 |
| 3,465,950 | 9/1969 | Freid | 416/142 R |
| 3,565,028 | 2/1971 | Hancks et al. | 114/20 |
| 3,608,509 | 9/1971 | Brooks et al. | 114/23 |
| 3,706,293 | 12/1972 | Hancks et al. | 114/20 |
| 3,738,270 | 6/1973 | Hargett et al. | 102/7 |
| 4,139,330 | 2/1979 | Neal | 416/143 |
| 4,571,192 | 2/1986 | Gongwer | 440/66 |
| 4,979,876 | 12/1990 | Chapman | 416/143 |
| 4,984,967 | 1/1991 | Cruzen | 416/143 |

FOREIGN PATENT DOCUMENTS

| | | | |
|---|---|---|---|
| 769768 | 9/1934 | France | 416/142 |
| 461247 | 9/1975 | U.S.S.R. | 416/142 |

*Primary Examiner*—Robert J. Oberleitner
*Assistant Examiner*—Clifford T. Bartz
*Attorney, Agent, or Firm*—W. K. Denson-Low

[57] ABSTRACT

A propulsion system for a submerged vehicle which operates at a relatively low RPM includes a pair of coaxial drive shafts for producing counterrotating torques. A first propeller unit is attached for rotation with one of the drive shafts and a second propeller units is attached for rotation with the other drive shaft. Each propeller unit includes a plurality of arcuate propeller blades which are deployed upon rotation of their respective drive shaft. Specifically, this deployment is from a first configuration wherein the blades are disposed along the surface of the vehicle and into a second configuration wherein the blades are extended from the surface of the vehicle.

8 Claims, 1 Drawing Sheet

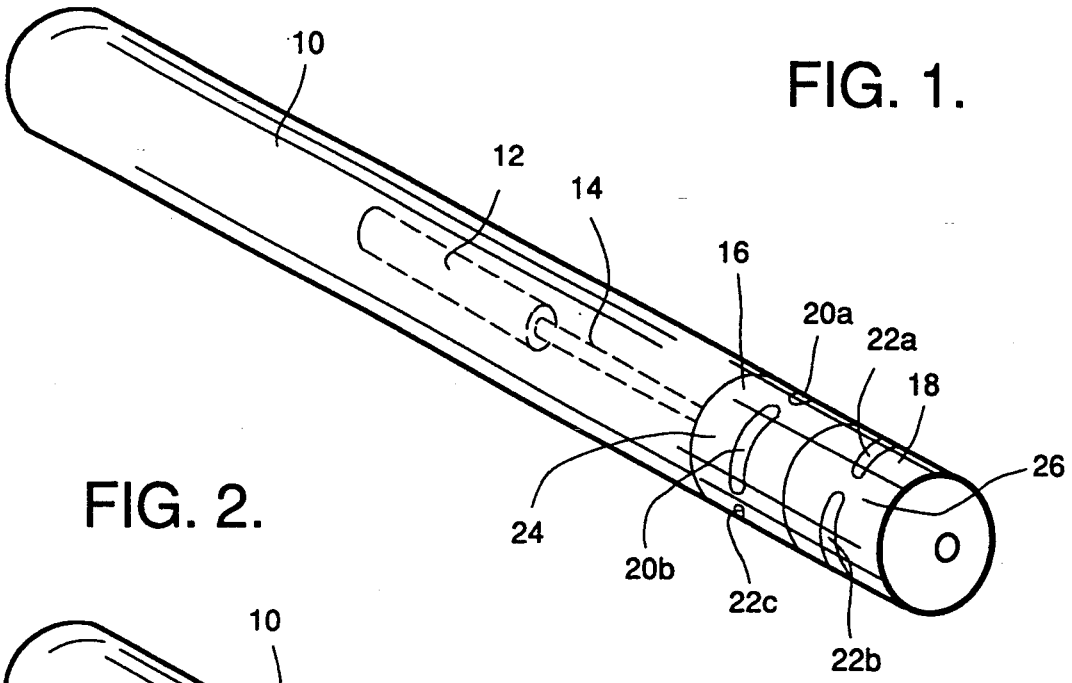
FIG. 1.
FIG. 2.
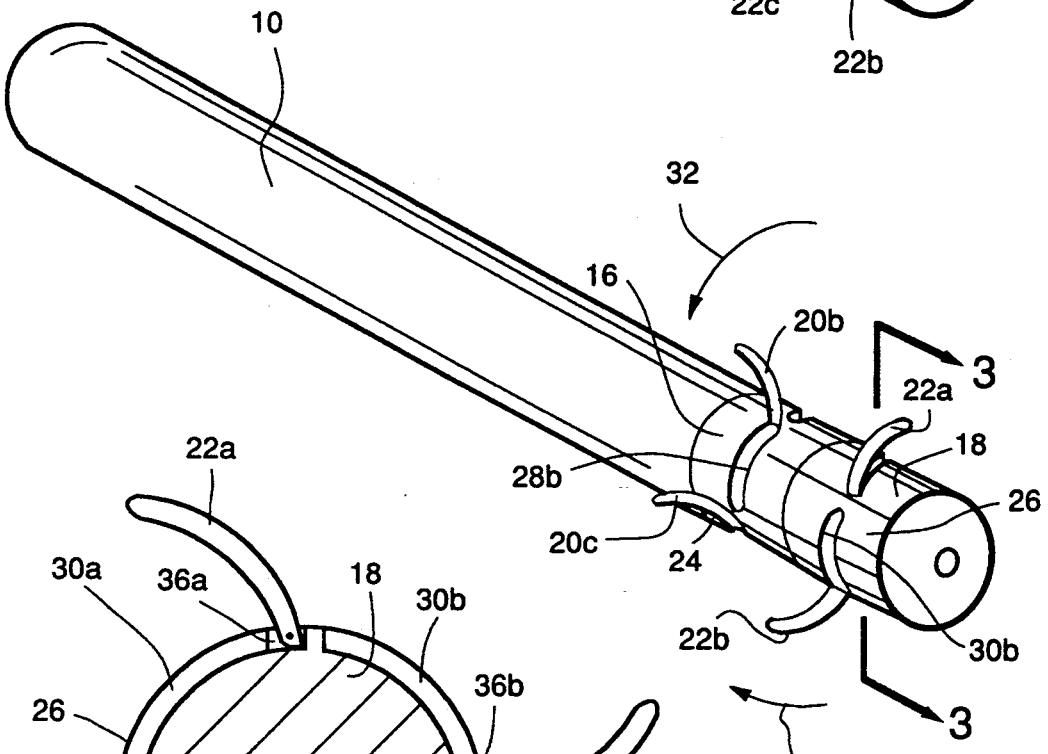
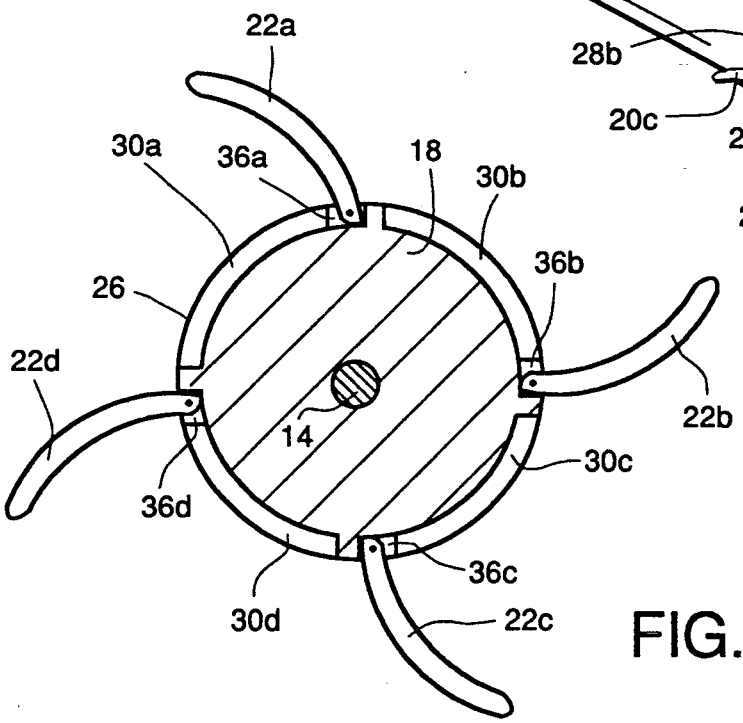
FIG. 3.

LARGE DIAMETER LOW RPM PROPELLER FOR TORPEDOES

This is a continuation of application Ser. No. 07/819,430, filed Jan. 10, 1992.

FIELD OF THE INVENTION

The present invention pertains generally to propulsion systems for underwater vehicles. More particularly, the present invention pertains to a propulsion system for use in propelling a torpedo. The present invention is particularly, but not exclusively, useful for propelling a torpedo after it has be launched from a tube.

BACKGROUND OF THE INVENTION

The use of submerged torpedoes for various underwater missions is well known. Further, it is well known that torpedoes can be launched from aircraft, surface ships or from submarines. The particular launching platform is, of course, an important consideration in the design and configuration of the torpedo. The present invention is primarily concerned with underwater launched torpedoes and the constraints within which such torpedoes must operate. More particularly, the present invention is concerned with propeller propulsion systems for such torpedoes.

It is well known that whenever turbulent flow develops on a propeller blade, the efficiency of the blade diminishes significantly. Further, for underwater operations the phenomenon of cavitation, which is an aggravated form of turbulence, also reduces the blades efficiencies. Accordingly, one design feature which can be used to avoid these unwanted effects is to operate the propeller at reduced rates of rotation, i.e. lower RPM. However, with lower RPM, in order to obtain the same propulsive force it will generally be necessary to have a greater surface area for the propeller blade.

For tube launched torpedoes, such as is generally the case when a torpedo is launched underwater, the configuration of the torpedo must be compatible with the launching tube. An example of such a torpedo, which is constrained by the confining dimensions of a launch tube, is provided in U.S. Pat. No. 3,565,028 which issued to Hancks et al. for an invention entitled "Steerable Self-Propelled Submersible". Further, this invention and the invention disclosed in U.S. Pat. No. 2,094,997 which issued to Lucich for an invention entitled "Propelling Mechanism for Torpedoes" both disclose counterrotating propellers as a way for controlling the torque which is generated during propulsion of their respective torpedoes through the water. The propellers disclosed for these inventions are, however, relatively short. And this is particularly so for the tube launched torpedo disclosed in the Hancks et al. patent. Consequently, in order to develop significant thrust, these propellers must operate at relatively high RPM with the consequent drawbacks mentioned above.

As mentioned earlier, one way in which to avoid the disadvantages of a high RPM propeller is to make the propeller larger and let it operate at the lower RPM. For underwater torpedoes, however, the torpedo must be compatible with a launch tube. With this in mind, the present invention recognizes that a torpedo with a propulsion system that can be reconfigured with long blade propellers after launch can operate at lower RPM. Further, the present invention recognizes this can be done by allowing the propeller blades to extend from the torpedo after it has been launched. Although U.S. Pat. No. 2,847,960 which issued to Endrezze for an invention entitled "Radial Expanding Missile Torpedo Fins" discloses extendable fins for a torpedo it does not address the problems confronted by a rotating propeller.

In light of the above, it is an object of the present invention to provide a low RPM propulsion system for a submerged vehicle which can be launched under water from a tube having a restrictive diameter. Another object of the present invention is to provide a low RPM propulsion system for a submerged vehicle which provides suitable propulsive force for the vehicle while minimizing turbulent flow over the propeller blades. Yet another object of the present invention is to provide a low RPM propulsion system for a submerged vehicle which is reliable and predictable in its operation. Still another object of the present invention is to provide a low RPM propulsion system for a submerged vehicle which is easy to use, relatively simple to manufacture, and comparatively cost effective.

SUMMARY OF THE INVENTION

A low RPM propulsion system for a submerged vehicle includes a pair of coaxial counterrotating drive shafts with a first propeller unit fixedly attached to one of the drive shafts and a second propeller unit fixedly attached to the other drive shaft. Each propeller unit has a plurality of arcuate blades which are extendable from a first configuration, wherein the blades are folded along the surface of the vehicle, and into a second configuration, wherein the blades are deployed to extend from the surface of the vehicle. As intended for the present invention, each propeller unit is substantially cylindrically shaped and has four blades hingedly attached to it. Each blade has a length which is approximately equal to an arc distance that is one quarter of the circumference of the propeller unit. Further, each propeller unit includes a plurality of detents which are formed into the unit and which are engageable with an associated blade to hold the blade extended from the vehicle in its second configuration.

In the operation of the low RPM propulsion system for a submerged vehicle, as intended for the present invention, the blades of the propeller units are initially folded along the surface of the vehicle in their first configuration. While in this first configuration, the vehicle is capable of being placed into a launch tube and shot therefrom by compressed air or ram to clear the vehicle from the launching vessel. A drive motor in the vehicle can then be activated to cause rotation of the coaxial drive shafts and their respectively attached propeller units. Centrifugal force generated on the blades of the propeller units by this rotation of the drive shafts then causes the blades to extend from their first configuration and into their second configuration. The blades then lock into position upon engagement with their respective detents and the vehicle is propelled through the water.

The novel features of this invention, as well as the invention itself, both as to its structure and its operation will be best understood from the accompanying drawings, taken in conjunction with the accompanying description, in which similar reference characters refer to similar parts, and in which:

BRIEF DESCRIPTION OF THE DRAWINGS

FIG. 1 is a perspective view of a torpedo employing the propulsion system of the present invention, and shown in a first configuration with portions shown in phantom for clarity;

FIG. 2 is a perspective view of the torpedo shown in FIG. 1 with the torpedo in a second configuration; and FIG. 3 is a cross sectional view of a propeller unit of the present invention as seen along the line 3—3 in FIG. 2.

DESCRIPTION OF THE PREFERRED EMBODIMENTS

Referring initially to FIG. 1, a torpedo employing the propulsion system of the present invention is shown and designated 10. The present invention, however, is not limited to the torpedo 10. Indeed, any submersible vehicle or other object which is to be propelled under water and which can accommodate the propulsion system of the present invention would be appropriate. Nevertheless, for the particular torpedo 10 shown in FIG. 1 it will be seen that a drive mechanism 12 (shown in phantom) is connected via a coaxial drive shaft 14 (also shown in phantom) to a forward propeller unit 16 and an aft propeller unit 18. As intended for the present invention, the drive mechanism 12 counterrotates the propeller units 16 and 18.

FIG. 1 also shows that the forward propeller unit 16 includes a plurality of arcuate blades 20*a*, 20*b*, and 20*c*. Actually, for the preferred embodiment there are four such blades and what would be a blade 20*d* is not shown. Similarly, the aft propeller unit 18 includes a plurality of arcuate blades. Again, there are preferably four such blades. Only the blades 22*a* and 22*b*, however, are shown in FIG. 2. A quick reference to FIG. 3 indicates that there are preferably blades 22 *a–d* attached to the aft propeller unit 18.

In accordance with the present invention, the torpedo 10 can assume either of two configurations. A first configuration is shown in FIG. 1 wherein the arcuate blades 20 are folded to lie along the curved surface 24 of forward propeller unit 16. Similarly, for the first configuration of Torpedo 10, the arcuate blades 22 are also folded to lie along the curved surface 26 of aft propeller unit 18. On the other hand, FIG. 2 shows a second configuration for the torpedo 10 wherein the blades 20 *a–d* are deployed from respective slots 28 *a–d* in the surface 24 of forward propeller unit 16 to extend outwardly from forward propeller unit 16. FIG. 2 also shows that, for the second configuration, the blades 22 *a–d* are deployed from respective slots 30 *a–d* in the surface 26 of aft propeller unit 18 to extend outwardly from aft propeller unit 18.

As perhaps best appreciated by cross referencing FIG. 1 and FIG. 2, the transition from the first configuration (FIG. 1), to the second configuration (FIG. 2) is accomplished by activation of the drive mechanism 12. Specifically, as drive mechanism 12 rotates forward propeller unit 16 in the direction of arrow 32, centrifugal force will cause the blades 20 *a–d* to deploy. At the same time, a counter rotation of the aft propeller unit 18 by the drive mechanism 12 in the direction of arrow 34, centrifugal force will cause the blades 22 *a–d* to deploy.

As is recognized by the present invention, the first configuration establishes a low launch profile for the torpedo 10. On the other hand, the second configuration effectively allows use of longer blades and, consequently, it permits operation of the propeller units 16 and 18 at a relatively low RPM. The actual RPM at which the drive mechanism 12 counterrotates the propeller units 16 and 18 will depend on certain operational objectives. For example, the speed desired for the torpedo 10 and the hydrodynamic profile of the blades 20 *a–d* and 22 *a–d* can be varied according to the needs of the operator. No effort is made here to quantify the required structural parameters for proper operation of the torpedo 10 other than to comment on the necessity that the counter rotation of the propeller units 16 and 18 be hydrodynamically efficient.

FIG. 3 best shows some additional features of the propulsion system for the present invention. There it will be clear seen that each of the blades 22 *a–d* is arcuate and has a curvature which is compatible with the curved surface 26 of the propeller unit. This, of course, facilitates the folding of the blades 22 *a–d* into their respective slots 30 *a–d* when the torpedo 10 is in its first configuration. Additionally, FIG. 3 indicates that the length of each blade 22 *a–d* is approximately equal to an arc distance that is one quarter of the of the circumference of the surface 26 in this cross section. As will be appreciated by the skilled artisan, the four blades 22 *a–d* are only exemplary. Accordingly, the number of blades and their consequent length can be varied as desired. Further, although the disclosure here has specifically pertained to the blades 22 *a–d* and aft propeller unit 18, it is to be understood that the same requirements apply equally to the blades 20 *a–d* and forward propeller unit 16.

In the operation of the torpedo 10 of the present invention, it is intended that the blades 20 *a–d* and blades 22 *a–d* be of a fixed pitch and that they be counter rotated with their respective propeller units 16 and 18 by drive mechanism 12 at substantially the same RPM. Further, once the transition has been made from the first configuration to the second configuration, the blades will remain deployed. To assist in maintaining torpedo 10 in its second configuration, an individual detent can be disposed on the propeller unit to engage the blade and hold the blade in its deployed condition. For example, in FIG. 3, each blade 22 *a–d* is shown engaged with a respective detent 36 *a–d*. The actual construction of the detents 36 *a–d* are a matter of design choice and can manufactured in any manner well known in the art for the above stated purpose.

While the particular low RPM propulsion system for a submerged vehicle as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A low RPM underwater propulsion system for a submerged vehicle which comprises:

a drive mechanism for producing counterrotating torques;

a first propeller unit fixedly attached to said drive mechanism, said first propeller unit having a cylindrically shaped cross-section providing a curved outer surface and having a plurality of blades, each said blade being hingedly attached to said propeller unit, said outer surface of said first propeller unit having a plurality of arcuate slots for housing said plurality of blades in a first configuration, each of said blades being curved to conform to the outer surface of said first propeller unit to minimize the cross-section of the first propeller unit in said first configuration, said plurality of blades being deployed in a second configuration by centrifugal force upon activation of said drive mechanism for rotation of said first propeller unit in a first direction at a first RPM, said deployment of each of said blades on said first propeller unit occurring within a first plane perpendicular to a thrust axis of said propulsion system; and a second propeller unit fixedly attached to said drive mechanism, said second propeller unit having a cylindrically shaped cross-section providing a curved outer surface and having a plurality of blades, each said blade being hingedly attached to said second propeller unit, said outer surface of said second propeller unit having a plurality of arcuate slots for housing said plurality of blades in a first configuration, each of said blades being curved to conform to the outer surface of said second propeller unit to minimize the cross-section of the second propeller unit in said first configuration, said plurality of blades being developed in a second configuration by centrifugal force upon activation of said drive mechanism for rotation of said second propeller unit in a second direction at a second RPM, said deployment of each of said blades on said second propeller unit occurring within a second plane perpendicular to a thrust axis of said propulsion system.

2. A propulsion system as claimed in claim 1 wherein said RPM in said first direction is substantially equal to said RPM in said second direction.

3. A propulsion system as claimed in claim 1 wherein each said blade is arcuate.

4. A propulsion system as claimed in claim 3 wherein each said first and second propeller units further comprise a plurality of detents formed into said unit, and each said blade is positioned for engagement with one of said detents to hold said blade in its developed configuration.

5. A propulsion system as claimed in claim 4 wherein each said blade is hydrodynamically shaped to propel said torpedo upon rotation of said blade by its respective propeller unit.

6. A propulsion system as claimed in claim 5 wherein each said propeller unit has four said blades mounted thereon, and each said blade has a length which is approximately equal to an arc distance that is one quarter circumference of said outer surface of said respective propeller unit.

7. A system for moving a substantially cylindrically shaped torpedo having a curved outer surface, comprising:

a first cylindrically shaped propulsion mechanism having a curved outer surface;

a second cylindrically shaped propulsion mechanism having a curved outer surface;

drive means including a coaxial drive shaft for counterrotating said first propulsion mechanism and said second propulsion mechanism in first and second directions at respective first and second low RPM's that are substantially equal;

a first plurality of arcuate blades hingedly attached to said first propulsion mechanism, each said blade being extendably deployed upon rotation of said first propulsion mechanism in said first direction from a first configuration wherein said blade is disposed substantially within said outer surface of said first propulsion mechanism and into a second configuration wherein said blade is deployed to extend beyond said outer surface, each of said blades being curved to conform with said first propulsion means outer surface when in said first configuration and being positioned to deploy by centrifugal force resulting from rotation of said first propulsion mechanism, said deployment of each of said blades on said first propulsion mechanism occurring within a first plane perpendicular to a thrust axis of said system;

a second plurality of arcuate blades hingedly attached to said second propulsion mechanism, each said blade being extendably deployed upon rotation of said second propulsion mechanism in a second direction from a first configuration wherein said blade is disposed substantially within said outer surface and into a second configuration wherein said blade is deployed to extend beyond said outer surface, each of said blades being curved to conform with said second propulsion means outer surface when in said first configuration and being positioned to deploy by centrifugal force resulting from rotation of said second propulsion mechanism, said deployment of each of said blades on said second propulsion mechanism occurring within a second plane perpendicular to a thrust axis of said system;

a plurality of detents formed in said first propulsion mechanism for holding said first plurality of blades in their deployed configuration; and a plurality of detents formed in said second propulsion mechanism for holding said second plurality of blades in their deployed configuration.

8. A system as recited in claim 7 wherein each said blade is hydrodynamically shaped to propel said torpedo upon rotation of said blade by its respective propulsion mechanism, and wherein each said propulsion mechanism has four said blades mounted thereon, and each said blade has a length which is approximately equal to an arc distance that is one quarter circumference of said outer surface of said respective propulsion mechanism.

* * * * *